US005327965A

United States Patent [19]

Stephen et al.

[11] Patent Number: 5,327,965

[45] Date of Patent: Jul. 12, 1994

[54] WELLHEAD COMPLETION SYSTEM

[75] Inventors: Garry R. Stephen, Aberdeen, Scotland; Dale B. Marietta, Singapore, Singapore; Norman Brammer, Aberdeen, Scotland; Casimir J. Fritshe, Gassin, France; Lawrence A. Eckert, Houston, Tex.; Allan C. Sharp, Aberdeen, Scotland

[73] Assignee: ABB Vetco Gray Inc., Houston, Tex.

[21] Appl. No.: 41,120

[22] Filed: Apr. 1, 1993

[51] Int. Cl.[5] ..... E21B 33/04

[52] U.S. Cl. ..... 166/208; 166/182; 166/217; 285/141

[58] Field of Search ..... 166/208, 115, 182, 217, 166/125; 285/141, 139

[56] References Cited

U.S. PATENT DOCUMENTS

| | | | |
|---|---|---|---|
| 4,469,172 | 9/1984 | Clarke | 166/115 |
| 4,595,053 | 6/1986 | Watkins et al. | 285/141 X |
| 4,691,780 | 9/1987 | Galle, Jr. et al. | 166/208 X |
| 4,757,860 | 7/1988 | Reimert | 166/208 |
| 4,790,572 | 12/1988 | Slyker | 166/208 X |
| 4,823,871 | 4/1989 | McEver et al. | 166/182 |
| 4,886,121 | 12/1989 | Demny et al. | 166/382 |
| 4,949,786 | 8/1990 | Eckert et al. | 166/208 |
| 5,174,376 | 12/1992 | Singeetham | 166/208 |

*Primary Examiner*—Hoang C. Dang
*Attorney, Agent, or Firm*—James E. Bradley

[57] ABSTRACT

A well completion system utilizes a seal which carries its own load ring. The seal is lowered into the bore of a wellhead housing around a tubular member. The seal carries a split load ring, which once positioned will move outward into engagement with a groove formed in the wellhead housing. A locking assembly will lock the seal to the wellhead housing. The locking assembly has a casing lock ring which will secure to the upper end of a section of casing, if the casing has been cut due to an emergency stuck condition. A tubing hanger lands over the locking assembly. The tubing hanger is retained by an actuating ring and lock ring that are independent of the tubing hanger seal.

15 Claims, 2 Drawing Sheets

WELLHEAD COMPLETION SYSTEM

BACKGROUND OF THE INVENTION

1. Field of the invention

This invention relates in general to wellhead equipment for oil and gas wells, and in particular to an emergency casing hanger seal.

2. Description of the Prior Art

In a well of the type concerned herein, a wellhead housing has a landing profile or shoulder within its bore. When running casing conventionally, a casing hanger is installed on the upper end of the string of casing. The casing hanger lands on the landing shoulder in the bore of the wellhead housing.

After cementing, a seal is positioned between the casing and the wellhead housing. The seal locates between machined surfaces on the wellhead housing and the casing hanger. A tubing hanger may be installed over the uppermost casing hanger. The tubing hanger is normally held by lockdown screws if the wellhead housing is located at the surface. The tubing hanger secures to the tubing which extends into the well. A tubing hanger seal locates between the tubing hanger and the wellhead housing.

Occasionally, the casing will not proceed smoothly to the bottom of the well. When this occurs, the casing hanger will not be properly positioned to land in the wellhead housing. Generally, when this happens, the casing cannot be retrieved to the surface and becomes stuck. In that case, the casing must be cut above the landing shoulder after cementing. In the prior art, the casing is supported by slips in the wellhead housing.

A problem exists in sealing against the casing stub, because the casing does not have a smooth machined surface for receiving a seal. The casing outer diameter has a high dimensional variation. The outer diameter may be slightly oval shaped. The surface of the casing may have many defects, such as rust, pock marks and tong marks. Various seals have proposed for sealing against the casing stub. However, improvements in locking the seal in the wellhead housing are desired.

Another desirable feature would be a means that would prevent the casing from moving upward due to temperature increase in the well during production. Movement of the casing could have damaging effects on the seal. Also, it would be desired to have a tubing hanger lockdown that did not employ lockdown screws, and would allow the seal to be removed without removing the lockdown.

SUMMARY OF THE INVENTION

The wellhead system of this invention utilizes a seal which carried a split load ring. The seal has a cam member at its lower end that holds the split load ring in a retracted position as the seal is being lowered into the bore of the wellhead housing. Once the seal lands on previously installed structure in the bore of the wellhead housing, the ring is released to spring out into a groove formed in the bore of the wellhead housing. The load ring then supports the downward force placed on the seal when it is being energized.

Preferably the seal is of a type having inner and outer walls separated by an annular cavity. An energizing ring moves downward in the cavity to cause the inner and outer walls to seal to the wellhead housing and to the tubular member or casing in the well. Also, preferably, the load ring is an inward biased ring that is retained initially in place by a shear pin.

A lockdown mechanism then will lock to the upper end of the seal to prevent the energizing ring from moving upward. The lockdown mechanism employs inner and outer sleeves which are secured by mating threads. Rotating one of the sleeves relative to the other advances a locking member into an upper groove. The locking member bears against the energizing ring to prevent it from moving upward.

Further, a casing lock ring secures by threads to the locking mechanism. The casing lock ring has an inward extending flange that locates over the upper end of the casing to prevent its upward growth.

The tubing hanger lands on a shoulder. A lock ring is carried by the tubing hanger in a collapsed position. An actuating ring, when moved downward by a running tool, urges the lock ring outward to engage a groove for holding the tubing hanger in place. The actuating ring and lock ring have a mating locking taper to maintain the lock ring in the outer position. A tubing hanger seal then lands on top of the actuating ring and is energized to seal between the tubing hanger and the wellhead housing.

DETAILED DESCRIPTION OF THE INVENTION

Figure 1:
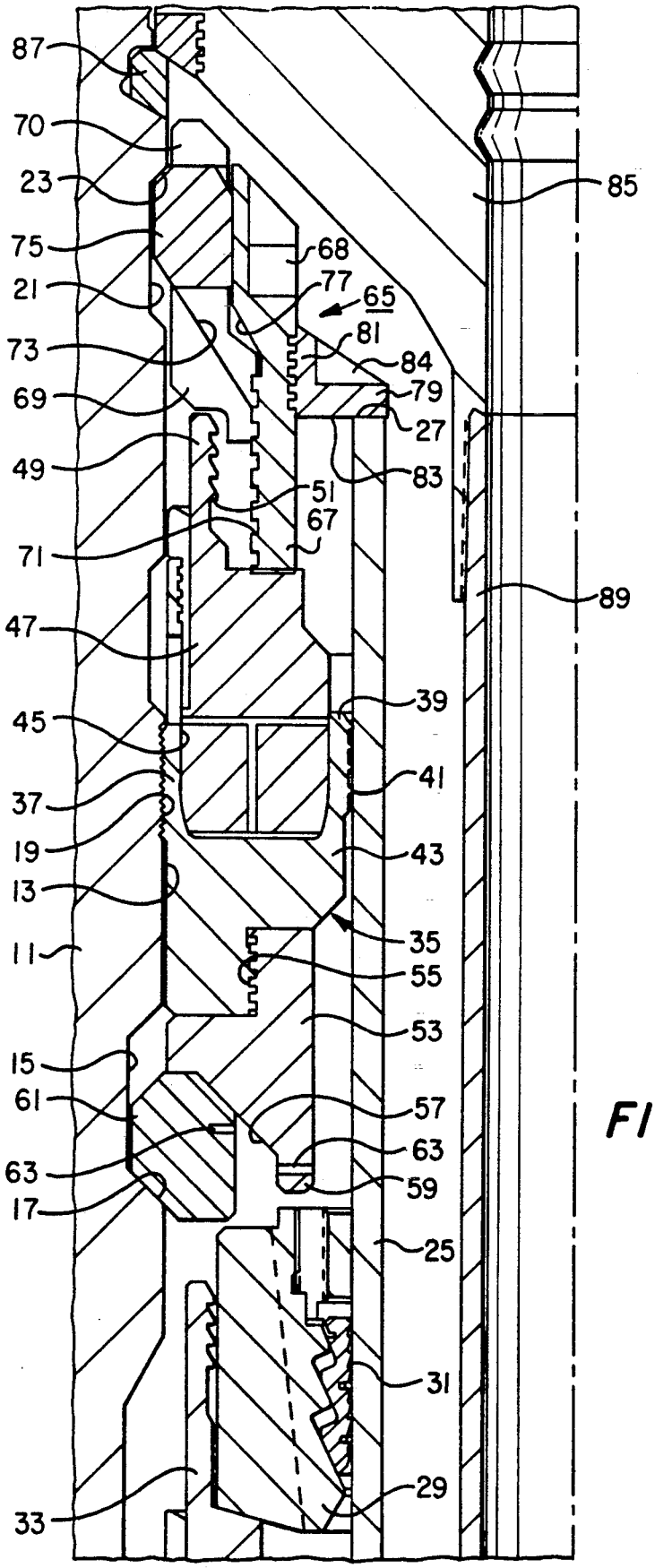
FIG. 1 is a quarter vertical sectional view illustrating a lower portion of a wellhead system constructed in accordance with this invention.

Referring to FIG. 1, wellhead housing 11 is a tubular member located at the upper end of a well. Wellhead housing 11 has an axial bore with a bore wall 13. A lower groove 15 extends circumferentially around bore wall 13. Lower groove 15 has a conical load shoulder 17 that faces upward and inward. The inner diameter of load shoulder 17 is the same as the inner diameter of bore wall 13 directly below and above groove 15. The inner diameter of load shoulder 17 is no less than the inner diameter of bore wall 13 at any point above groove 15.

A set of wickers 19 are formed in bore wall 13 above lower groove 15. Wickers 19 are small triangular parallel grooves. An upper groove 21 locates in bore wall 13 above wickers 19. Upper groove 21 has the same general configuration as lower groove 15. It has a conical lock shoulder 23 that faces downward and inward.

A section of casing 25 extends through wellhead housing 11. In this instance, casing 25 has become stuck and cannot be moved further downward into the well or pulled upward. As a result, casing 25 has an upper end 27 that has been cut.

After cutting, a slip bowl 29 is placed over casing 25. Slip bowl 29 has slips 31 that grip casing 25 to support it coaxially in the bore wall 13 and prevent downward movement. Casing 25 will be cemented into place. Slip bowl 29 will land on previously installed structure located in wellhead housing 11. For example, the previously installed structure might be an upper portion of a casing hanger seal 33 which has been installed previously for sealing between a casing hanger for a larger diameter string of casing (not shown) and wellhead housing 11.

After slips 31 are installed and casing 25 cemented in place, a seal 35 will be lowered into the annular space between bore wall 13 and casing 25. Seal 35 is of a metal-to-metal type having an outer wall 37 and an inner wall 39 spaced inward. In the embodiment shown, outer wall 37 embeds into wickers 19. Inner wall 39 has a plurality of deformable cylindrical bands 41 separated by an inlay of soft metal for sealing against the rough exterior of casing 25. Outer wall 37 and inner wall 39 are joined at the bottom by a base 43. An annular central cavity 45 separates outer wall 37 from inner wall 39.

An energizing ring 47 is used to deform outer wall 37 and inner wall 39 outward into contact with the bore wall 13 and casing 25. Energizing ring 47 moves downward in cavity 45 from an upper position to the lower position shown. Energizing ring 47 has an upper section 49. Upper section 49 has an inner diameter containing grooves 51. Upper section 49 is engaged by a running tool (not shown) and serves as part of a means for lowering seal 35 into wellhead housing 11.

A cam member 53 is secured by threads 55 to base 43 of seal 35. Cam member 53 is a ring having a conical shoulder or cam surface 57 that faces downward and outward. A lower section 59 depends downward from cam surface 57 and is cylindrical.

A load ring 61 is carried by cam member 53. Load ring 61 has a mating conical surface that mates with cam surface 57. Load ring 61 is a split ring, preferably inwardly biased, and initially held in place by a shear pin 63. In the initial retracted position, load ring 61 will be located in a contracted position further downward on cam surface 57. Load ring 61 contacts the upper end of slip bowl 29 as the running tool lowers seal 35 in place. This causes shear pin 63 to shear. Cam surface 57 then pushes load ring 61 outward to engage groove 15. An outer conical surface on load ring 61 mates with load shoulder 17. Downward load imposed on seal 35 transmits through base 43, cam member 53, and load ring 61 to load shoulder 17.

After seal 35 is installed, a locking assembly 65 is secured to the upper end of seal 35 to prevent seal 35 from moving upward due to pressure in the well. Locking assembly 65 includes an inner sleeve 67 and an outer sleeve 69. Inner sleeve 67 has a lower end that abuts an upper portion of energizing ring 47. Inner sleeve 67 has external threads 71 that engage internal threads of outer sleeve 69. A running tool (not shown) will engage slots 68 in the upper end of inner sleeve 67 to cause it to rotate downward relative to outer sleeve 69. Outer sleeve 69 has slots 70 on its upper end that prevent its rotation while inner sleeve 67 is rotated.

Outer sleeve 69 locates above energizing ring upper portion 49. Outer sleeve 69 has a plurality of windows 73, each window 73 having a conical lower end. A dog 75 slides within each window 73. A cam surface 77 on inner sleeve 67 pushes each dog 75 out each window 73 when inner sleeve 67 is rotated downward with threads 71. Dogs 75 enter upper groove 21. Each dog 75 has a conical upper edge that abuts lock shoulder 23 to prevent upward movement of locking assembly 65.

A casing lock ring 79 secures by threads 81 to the inner diameter of inner sleeve 67. Casing lock ring 79 has an inward extending flange 83 that will contact the upper end 27 of casing 25. Slots 84 on the upper end of casing lock ring 79 enable it to be rotated downward against the upper end 27 of casing 25. Any upward force on casing 25 due to thermal expansion will be transmitted through casing lock ring 79 to inner sleeve 67, and from there to outer sleeve 69, to dogs 75, and to lock shoulder 23.

A tubing hanger 85 may then be installed over locking assembly 65. In the embodiment shown, tubing hanger 85 lands on a load ring 87 which forms a shoulder in wellhead housing 11. Tubing hanger 85 is secured to production tubing 89 through which fluid from the well will be produced.

Figure 2:
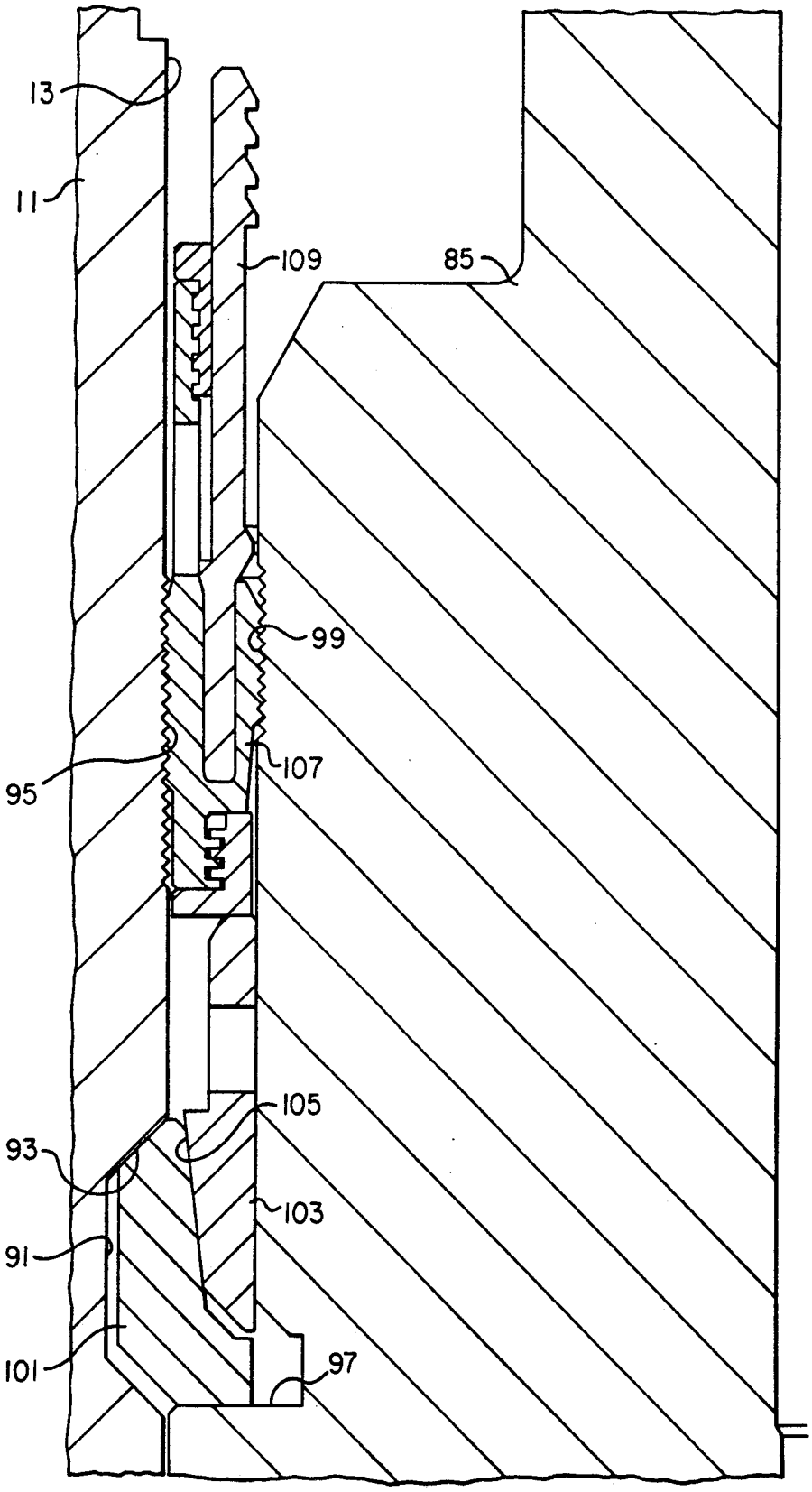
FIG. 2 is an enlarged quarter sectional view illustrating an upper portion of a wellhead system constructed in accordance with this invention.

Referring to FIG. 2, wellhead housing 11 has a tubing hanger groove 91 which has a downward facing locking shoulder 93. A set of wickers 95 locate above groove 91. A similar set of wickers 99 are located on tubing hanger 85 across from wickers 95 and above an upward facing shoulder 97.

Upward facing shoulder 97 locates at the lower end of groove 91. When tubing hanger 85 is lowered into place, a lock ring 101 will be installed in a contracted position on upward facing shoulder 97. Lock ring 101 is a split ring, inwardly biased.

An actuating ring 103 will also be carried by upward facing shoulder 97 as tubing hanger 85 is lowered into place. Actuating ring 103 locates above lock ring 101. Actuating ring 103 has a wedge surface 105 that engages a mating wedge surface on the inner side of lock ring 101. The inclination of wedge surface 105 is a locking taper, such that once actuating ring 103 is moved downward, it will lock in place. Upward force on lock ring 101 will not dislodge actuating ring 103. If retraction of lock ring 101 is desired, a running tool must be employed to pull actuating ring 103 upward in order to allow lock ring 101 to contract.

A seal 107, preferably a metal-to-metal type, may then be employed for sealing between the tubing hanger 85 and bore wall 13. Seal 107 is shown to be of a type having inner and outer walls separated by a cavity which receives an energizing ring 109. Seal 107 embeds into wickers 95 and 99.

In operation, if casing 25 becomes stuck, it will be cut off at upper end 27. Slips 31 will be installed and casing 25 will be cemented in place. Then, seal 35 will be lowered into wellhead housing 11. Load ring 61 will be in a contracted position held by shear pin 63. Load ring 61 will contact the upper end of slip bowl 29. Downward force of the running tool causes shear pin 63 to shear. Load ring 61 is moved outward into groove 15 as a result.

Continued downward force of the running tool (not shown) causes energizing ring 47 to move downward in cavity 45. This causes the outer wall 37 to embed into wickers 19. The inner wall 39 seals against casing 25. Fluid in cavity 45 is displaced out displacement passages formed in energizing ring 47.

Then, locking assembly 65 is lowered into place by a running tool. Initially, dogs 75 will be retracted, and inner sleeve 67 will be located in an upper position relative to outer sleeve 69. The running tool rotates inner sleeve 67 relative to outer sleeve 69. Inner sleeve 67 will move downward and abut energizing ring 47. The downward movement causes dogs 75 to move out in the windows 73, engaging groove 21. Then, the running tool rotates casing lock ring 79 downward and secures it in place with its flange 83 engaging upper end 27 of casing 25.

Then, tubing hanger 85 may be run in place with tubing 89. After landing on load ring 87 (FIG. 1), a running tool will push actuating ring 103 (FIG. 2) downward. Actuating ring 103 pushes lock ring 101 outward into groove 91, locking tubing hanger 85 in place. Then, a running tool will lower seal 107 into place and move energizing ring 109 downward to cause seal 107 to embed into the wickers 95, 99.

If it is desired at a later date to replace seal 107, it may be replaced by pulling upward on energizing ring 109 and retrieving seal 107. Actuating 103 will remain in its lower position as it will be held in place by the locking taper of wedge surface 105.

The invention has significant advantages. By carrying the load ring on the seal, the seal can be landed in and supported directly by the wellhead housing. The downward energizing force imposed on the seal is not transmitted to some other structure located in the well, such as slips. The locking assembly will lock the seal in its energized position directly to the wellhead housing. The locking assembly further will lock the upper end of the casing to prevent upward thermal growth. By locking the tubing hanger with a tapered wedge actuating ring, the tubing hanger will remain in place even though the tubing hanger seal is removed for replacement.

While the invention has been shown in only one of its forms, it should be apparent to those skilled in the art that it is not so limited, but is susceptible to various changes without departing from the scope of the invention.

We claim:

1. In a well having a wellhead housing having a bore with a cylindrical bore wall, an annular groove formed in the bore wall which defines an upward facing load shoulder, a tubular member extending coaxially within the bore and having a cylindrical exterior tubular member wall spaced inward from the bore wall, an improved apparatus for sealing between the tubular member wall and the bore wall, comprising in combination:

a seal;

means for allowing the seal to be lowered into the bore around the tubular member;

a split load ring;

carrying means at a lower end of the seal for carrying the load ring with the seal as it lowered into the bore around the tubular member, and for moving the load ring outward into engagement with the load shoulder to lock the seal to the wellhead housing; and energizing means for deforming the seal into engagement with the bore wall and tubular member wall.

2. The apparatus according to claim 1 wherein the load ring is carried in a contracted position while being lowered into the bore with the seal, and wherein the carrying means includes a cam for urging the load ring outward into engagement with the load shoulder.

3. The apparatus according to claim 1 wherein the carrying means comprises:

a cam member located on the lower end of the seal, having a downward and outward facing cam shoulder; and shear pin means for retaining the load ring on the cam member in a contracted position, and for releasing the load ring to move outward into the groove when the load ring contacts a structure located in the bore below the load shoulder, the cam shoulder then pushing the load ring into the groove.

4. The apparatus according to claim 1 wherein the load shoulder has an inner diameter that is flush with an inner diameter of the bore.

5. In a well having a wellhead housing having a bore with a cylindrical bore wall, an annular groove formed in the bore wall which defines an upward facing load shoulder having an inner diameter that is flush with an inner diameter of the bore wall, a tubular member extending coaxially within the bore and having a cylindrical exterior tubular member wall spaced inward from the bore wall, an improved apparatus for sealing between the tubular member wall and the bore wall, comprising in combination:

a metal seal having inner and outer cylindrical walls separated by an annular cavity and joined at a lower end by a base;

a cam member fixed on the base of the seal, having a downward and outward facing cam shoulder;

a split load ring;

means for retaining the load ring on the cam member in a contracted position while the seal is lowered around the tubular member, and for releasing the load ring to move outward into the groove when the load ring contacts structure located in the bore below the load shoulder, the cam shoulder then pushing the load ring into the groove to lock the seal to the wellhead housing; and an energizing ring carried by the seal and movable between an upper position and a lower position, for moving downward in the cavity for deforming the seal into engagement with the bore wall and tubular member wall.

6. The apparatus according to claim 5 wherein the tubular member is a section of casing.

7. The apparatus according to claim 5 further comprising locking means for locking the energizing ring to the wellhead housing while in the lower position.

8. The apparatus according to claim 5 wherein the tubular member is a section of casing having a cut upper end, and wherein the apparatus further comprises:

energizing ring locking means for locking the energizing ring to the wellhead housing while in the lower position; and casing locking means mounted to the energizing ring locking means for engaging the upper end of the casing to prevent upward movement of the casing due to temperature increase.

9. In a well having a wellhead housing having a bore with a cylindrical bore wall, an annular lower groove formed in the bore wall which defines an upward facing load shoulder having an inner diameter that is flush with an inner diameter of the bore wall, an annular upper groove located above the lower groove, a section of casing extending coaxially within the bore, the casing having a cut upper end within the bore, an improved apparatus for supporting the casing and sealing between the casing and the bore wall, comprising in combination:

a set of slips positioned in the bore below the load shoulder and in engagement with the casing for supporting the casing in the wellhead housing;

a metal seal having inner and outer cylindrical walls separated by an annular cavity and joined at a lower end by a base;

a cam member fixed on the base of the seal, having a downward and outward facing cam shoulder;

a split load ring;

shear pin means for retaining the load ring on the cam member in a contracted position while the seal is lowered around the tubular member, and for releasing the load ring to move outward into the lower groove when the load ring contacts an upper end of the slips, the cam shoulder then pushing the load ring into engagement with the load shoulder to lock the seal to the wellhead housing;

an energizing ring carried by the seal and movable between an upper position and a lower position, for moving downward in the cavity for deforming the seal into engagement with the bore wall and the tubular member wall; and energizing ring locking means in engagement with the energizing ring and the upper groove for locking the energizing ring to the wellhead housing while in the lower position.

10. The apparatus according to claim 9, further comprising:

casing locking means mounted to the energizing ring locking means for engaging the upper end of the casing to prevent upward movement of the casing due to temperature increase.

11. The apparatus according to claim 9 wherein the energizing ring locking means comprises:

an outer sleeve having a side wall containing at least one an aperture;

a locking element carried in the aperture for movement from an inner position to an outer position in engagement with the upper groove;

an inner sleeve having a lower end adapted to engage an upper end portion of the energizing ring, the inner sleeve located in the outer sleeve and having an outer cam surface that slidingly engages the locking element; and means for moving the sleeves axially relative to each other for moving the locking element to the outer position.

12. The apparatus according to claim 9 wherein the energizing ring locking means comprises:

an outer sleeve having a side wall containing at least one an aperture;

a locking element carried in the aperture for movement from an inner position to an outer position in engagement with the upper groove;

an inner sleeve having a lower end adapted to engage an upper end portion of the energizing ring, the inner sleeve located in the outer sleeve and having an outer cam surface that slidingly engages the locking element; and the inner and outer sleeves having mating threads, allowing the sleeves to move axially relative to each other for pushing the locking element to the outer position with the cam surface of the inner sleeve.

13. The apparatus according to claim 9 wherein the energizing ring locking means comprises:

inner and outer sleeves which threadingly engage each other to allow axial movement of the sleeves relative to each other;

one of the sleeves having a cam surface;

a locking element carried by the sleeves in engagement with the cam surface for movement from an inner position to an outer position in engagement with the upper groove when the sleeves are rotated relative to each other, with one of the sleeves bearing against an upper end of the energizing ring to prevent upward movement of the seal; and wherein the apparatus further comprises:

a casing lock ring that has mating threads for engaging one of the sleeves and an inward extending flange that engages the upper end of the casing to prevent upward movement of the casing due to temperature increase.

14. In a well having a wellhead housing having a bore with a cylindrical bore wall, an annular groove located within the bore, a section of casing extending coaxially within the bore, the casing having a cut upper end within the bore, and a seal located between the casing and the bore wall, an improved locking apparatus for locking the seal and the casing to the wellhead housing, comprising in combination:

inner and outer sleeves which threadingly engage each other to allow axial movement of the sleeves relative to each other;

one of the sleeves having a cam surface;

a locking element carried by the sleeves in engagement with the cam surface for movement from an inner position to an outer position in engagement with the groove when the sleeves are rotated relative to each other, and with one of the sleeves bearing against an upper end of the seal to prevent upward movement of the seal; and a casing lock ring that has mating threads for engaging one of the sleeves and an inward extending flange that engages the upper end of the casing to prevent upward movement of the casing due to temperature increase.

15. The locking apparatus according to claim 14 wherein the cam surface is located on the inner sleeve and the locking element is carried by the outer sleeve.

* * * * *